US010252099B2

(12) United States Patent
Karpachevskyy et al.

(10) Patent No.: US 10,252,099 B2
(45) Date of Patent: Apr. 9, 2019

(54) PORTABLE OPPOSABLY MOUNTED PULL UP DEVICE

(71) Applicants: Taras Karpachevskyy, Calgary (CA); Li Yu Yang, Calgary (CA)

(72) Inventors: Taras Karpachevskyy, Calgary (CA); Li Yu Yang, Calgary (CA)

( * ) Notice: Subject to any disclaimer, the term of this patent is extended or adjusted under 35 U.S.C. 154(b) by 0 days.

(21) Appl. No.: 14/690,470

(22) Filed: Apr. 20, 2015

(65) Prior Publication Data

US 2016/0303419 A1 Oct. 20, 2016

(51) Int. Cl.

| | |
|---|---|
| ***A63B 21/16*** | (2006.01) |
| ***A63B 23/12*** | (2006.01) |
| ***A63B 21/068*** | (2006.01) |
| ***A63B 21/00*** | (2006.01) |
| *A63B 71/00* | (2006.01) |

(52) U.S. Cl.
CPC ..... *A63B 21/1636* (2013.01); *A63B 21/068* (2013.01); *A63B 21/4035* (2015.10); *A63B 23/1218* (2013.01); *A63B 2071/0063* (2013.01); *A63B 2209/02* (2013.01); *A63B 2210/50* (2013.01)

(58) Field of Classification Search
CPC ..... A63B 21/1469; A63B 21/1484; A63B 21/1636; A63B 23/1218
USPC ..... 482/40, 904
See application file for complete search history.

(56) References Cited

U.S. PATENT DOCUMENTS

| | | | | |
|---|---|---|---|---|
| 3,716,232 | A * | 2/1973 | Johnson | A63B 1/005 482/40 |
| 5,429,571 | A * | 7/1995 | Smith | A63B 21/018 482/114 |
| 5,776,033 | A * | 7/1998 | Brown | A63B 1/00 248/317 |
| 5,947,875 | A * | 9/1999 | Cone | A47D 13/043 482/143 |
| 6,648,411 | B2 * | 11/2003 | Julien | A47D 13/107 297/273 |
| D518,534 | S * | 4/2006 | Giordano | D21/662 |
| 9,192,808 | B2 * | 11/2015 | Stone | A63B 21/002 |
| 2015/0105186 | A1 * | 4/2015 | Block | A63B 71/04 473/416 |

* cited by examiner

*Primary Examiner* — Joshua T Kennedy

(57) ABSTRACT

A door frame attachment system includes a pair of pivotable arms that can hook onto a door trim, held closed by a spring hidden in a cavity between the arms. The arms are connected to each other by a hollow shaft that allows various handles to be hung from the system. An exercise device includes the door frame attachment system and a handle suspended by a rope that passes through the hollow shaft. The device offers greater portability and attachment security compared to other inventions of this class, and it also provides greater user comfort by allowing the handles to rotate and pivot into a natural position.

5 Claims, 10 Drawing Sheets

PORTABLE OPPOSABLY MOUNTED PULL UP DEVICE

FIELD

The present invention pertains to fitness equipment, specifically to door or door jamb mounted exercise devices (USPTO class 482, subclass 40).

BACKGROUND

Pull-ups are a common exercise performed by people for training arm, shoulder, and back muscles. They involve gripping a constrained object with the individual's arms, suspending all or part of the individual's body weight on the arms, and lifting the individual's body upwards utilizing muscular effort. Despite requiring a certain minimum level of fitness in order to execute pull-ups, they offer many advantages in comparison to other popular types of arm exercises such as push-ups, arm curls, and bench presses. Compared with push-ups, pull-ups exercise more stabilizing muscle groups, they utilize the full body weight of the individual, and they place him or her in a vertical orientation, which may be found more natural and comfortable than the face down horizontal position required for push-ups. Compared with arm curls and bench presses, pull-ups utilize the individual's body weight as load, so the equipment required can be made significantly less heavy and more portable. In certain places, they require no extra equipment at all. Outdoors, pull-ups can be executed using elements of the natural environment, such as tree branches, or of the built environment, such as playground equipment. Indoors, however, few locations tend to have features which are suitable to being gripped by one's arms and having the individual's full or partial weight subjected upon them.

A significant number of devices have been invented in an attempt to rectify the relative lack of indoor features suitable for performing pull-ups in typical home or office environments. Many of these devices are intended to be secured to a door frame. Some, such as U.S. Pat. No. 7,066,866 B1 to Mobley, are full width horizontal pull-up bars meant to be affixed to a specific door permanently. The installation procedure involves securing the device to the target door with screws. Moving the device from one door to another may be a time consuming and relatively complex process, which the user may not wish to perform as frequently as doing pull-up exercise sessions. Having the device installed may also limit the height of the door opening, forcing taller individuals to duck under the permanent pull-up bar.

Devices which may be removed easily and quickly for individual sessions of pull-up exercises avoid the shortcomings of permanent doorway mounted pull-up bars. One popular design is described in U.S. Pat. No. D,348,706 to Harrell. It is a doorway mounted pull-up bar which may be installed onto a doorway quickly and also removed quickly. The device is substantially bulky, having a main grip bar extend horizontally beyond the edges of the door and a number of auxiliary bars attached to the main grip bar. As a result of this, the device cannot be installed onto doors wider than the fixed width of the main grip bar. Furthermore, because the main grip bar is uninterrupted across its width, in the course of a pull-up, the individual must pull back their head to avoid physical contact between the individual's face and the main grip bar. Despite these drawbacks, embodiments of this design enjoy tremendous consumer popularity. Several of such embodiments are regularly top sellers on websites such as amazon.com, and at the time of writing, one of these embodiments is the 20th highest selling fitness item on amazon.com.

The bulkiness of the previous device is largely addressed by U.S. Pat. No. 7,993,245 to Dorfman, a profiled strip intended to be installed on top of a door for performing pull-ups. It possesses significant size and weight advantages over the previously discussed designs, however, due to the elongated body intended to cover the length of a door, it suffers from limited portability compared to the opposably mounted design claimed herein. It also suffers from awkward exercise posture: because the device is installed directly on the upper edge of a solid door, the user may have to keep pushing their body away from the door while performing a pull-up. The same limitation is shared by the chin-up assembly described in U.S. Pat. No. 7,601,100 to Hinds and Bonneville.

U.S. Pat. No. 6,503,175 to Harrell describes a portable exercise device made up of two separated clamp members that are secured onto a support frame by a length-adjustable flexible attachment member which is interwoven between the clamp members. While the goals of this device are very similar to those of the present invention, the clamping mechanism is significantly less secure. Unlike the present invention which includes a pivotal joint, the clamping members described in U.S. Pat. No. 6,503,175 are pressed against the lip of the support frame directly by a flexible attachment member in combination with a body second edge. However, because the flexible attachment member is almost vertical at the attachment point, constrained by the geometry of the door frame, the inward horizontal component of the clamping force is a small fraction of the vertical component. Thus, only inward facing, 'hook' edges, or edges with a high coefficient of friction, are suitable for securing this device. The present invention incorporates a pivotal connection between the clamp members which uses the rotational torque from the supported individual's weight to push the clamping members off each other and horizontally into the support structure, allowing a secure, self-energizing connection to a wide range of support structure shapes.

SUMMARY

The portable opposably mounted pull up device of the present invention includes a clamping mechanism capable of attaching to a door frame of suitable width and a handle suspended underneath the clamping mechanism by one or more flexible members, such as ropes, straps, or others. The clamping mechanism is composed of two grip arms pivotally connected to each other. Each grip arm possesses a downward facing, substantially horizontal surface for resting on top of the door frame trim, a (possibly small) extension above said surface, and a means of attaching the flexible member connecting it to the handle component on the opposite side of the arm as the horizontal flat. The pivotal connection to the opposite arm component is located between the downward facing flat and the flexible member attachment means. This allows the arm components to close in on each other when weight is suspended from the handle underneath, ensuring the clamping mechanism remains securely attached to the door frame, as the extensions above each downward facing surface are pressed against the opposing sides of the wall on which the door frame is mounted.

This invention allows individuals to perform pull-up exercises while allowing, in a combination not offered by any of the prior art:

to install and remove the device onto any doorway frame of suitable dimensions quickly and easily, without any tools or hardware, and without altering or damaging the doorway frame;

to store or carry the device, with no prior disassembly, in a small travel bag, backpack, or in the carry-on luggage on an airplane, such that the individual may perform pull-ups in any suitable indoor environment they visit—home, school, work, hotel, etc.;

to enjoy the security of a self-energizing, opposable mounting system, which uses the individual's body weight to aid the stable attachment to both sides of any suitable doorway frame;

to perform pull-ups without having to avoid the obstacle presented by a full-width straight horizontal bar, thanks to two individual handles, each separately mounted to the door;

to allow the individual's wrists to swivel and pivot into a comfortable orientation into the course of a pull-up, thanks to the handles being suspended on flexible members;

to mount the device to a door which is unusually wide, or unusually narrow.

BRIEF DESCRIPTION OF DRAWINGS

The accompanying drawings which are incorporated in and form a part of the specification illustrate preferred embodiments of the present invention and, together with a description, serve to explain the principles of the invention. The drawings are not to be considered limiting of the scope of the invention. The drawings are not necessarily to scale and in some instances proportions may have been exaggerated in order to more clearly depict certain features. In the drawings.

DESCRIPTION OF EMBODIMENTS

Figure 1:
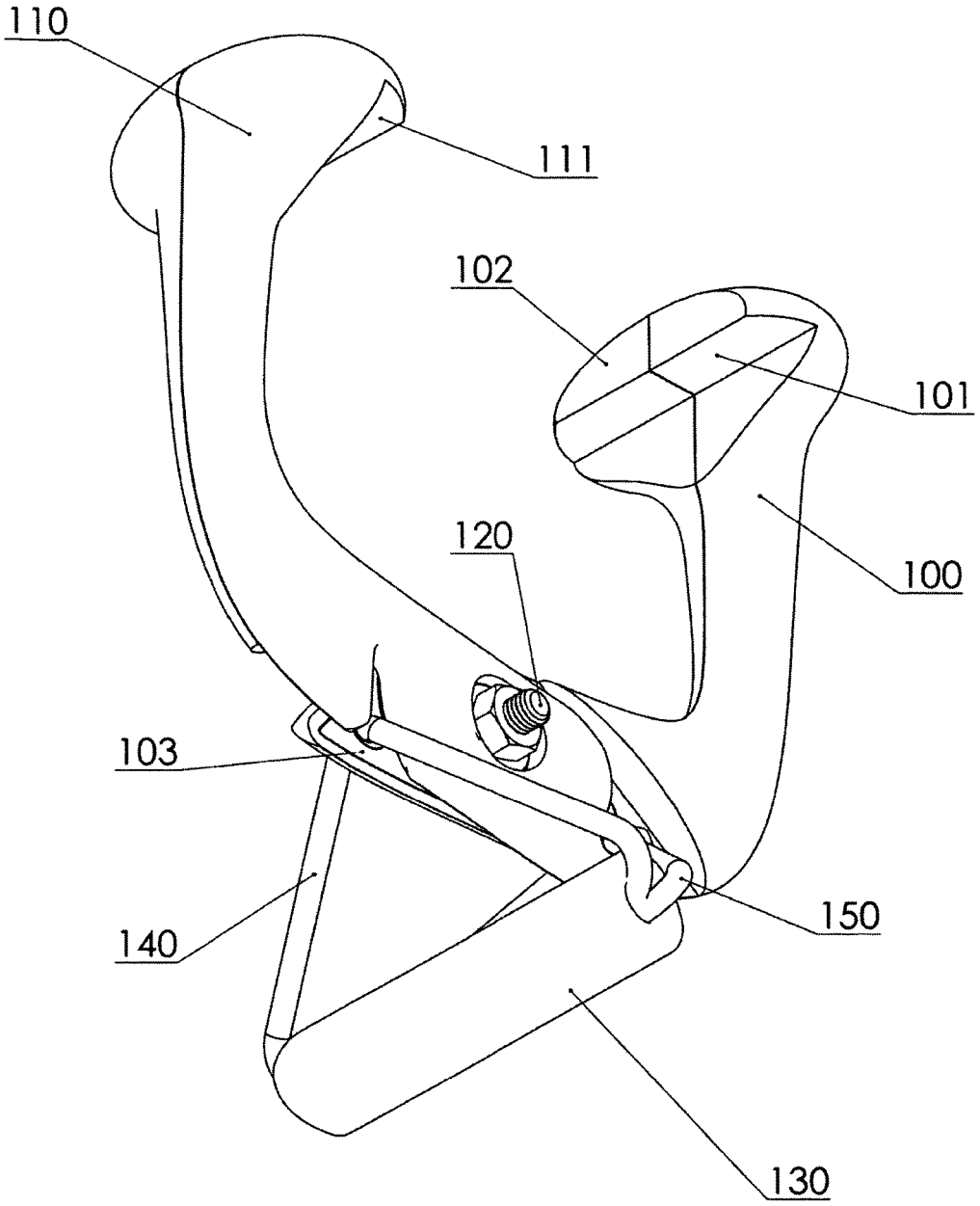
FIG. 1 is an isometric view showing an embodiment of the portable opposably mounted pull up device, while highlighting the main functional features of the invention.

The description that follows and the embodiments described therein are intended to clarify the nature and principles of the invention by means of examples. These examples are provided for the purposes of explanation, and not of limitation, of those principles and of the invention. In the description, similar parts are marked throughout the specification and the drawings with the same respective reference numerals.

Figure 2:
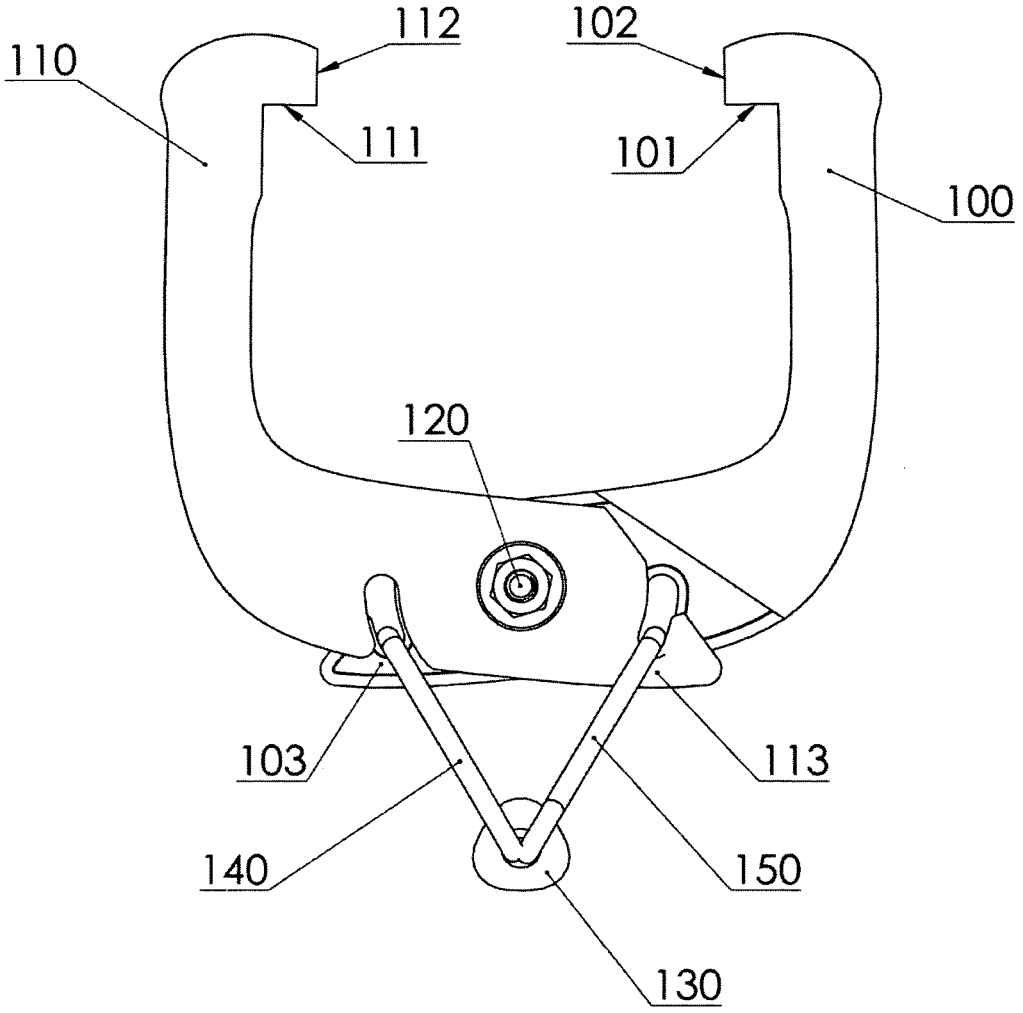
FIG. 2 is an orthographic view showing the same embodiment of the portable opposably mounted pull up device as FIG. 1.

Referring to FIGS. 1 and 2, shown—from two different angles—is one possible fully assembled embodiment of the present invention, highlighting its essential constituents and the features through which it interacts with external elements. The embodiment shown consists of a right grip arm 100, an identical left grip arm 110, a pivotal connection 120 between said grip arms, handle component 130, and rope loops 140 and 150 connecting the handle component to the grip arms. The right grip arm 100 features a substantially downward facing horizontal support surface 101, a substantially inward facing vertical support surface 102 and a hook 103. Similarly, the left grip arm 110 features a downward facing horizontal support surface 111, an inward facing vertical support surface 112, and a hook 113. Pivotal connection 120 holds the grip arms together while allowing them to rotate about each other. Hooks 103 and 113 allow the suspension of handle component 130 underneath the grip arms via ropes 140 and 150.

Figure 3:
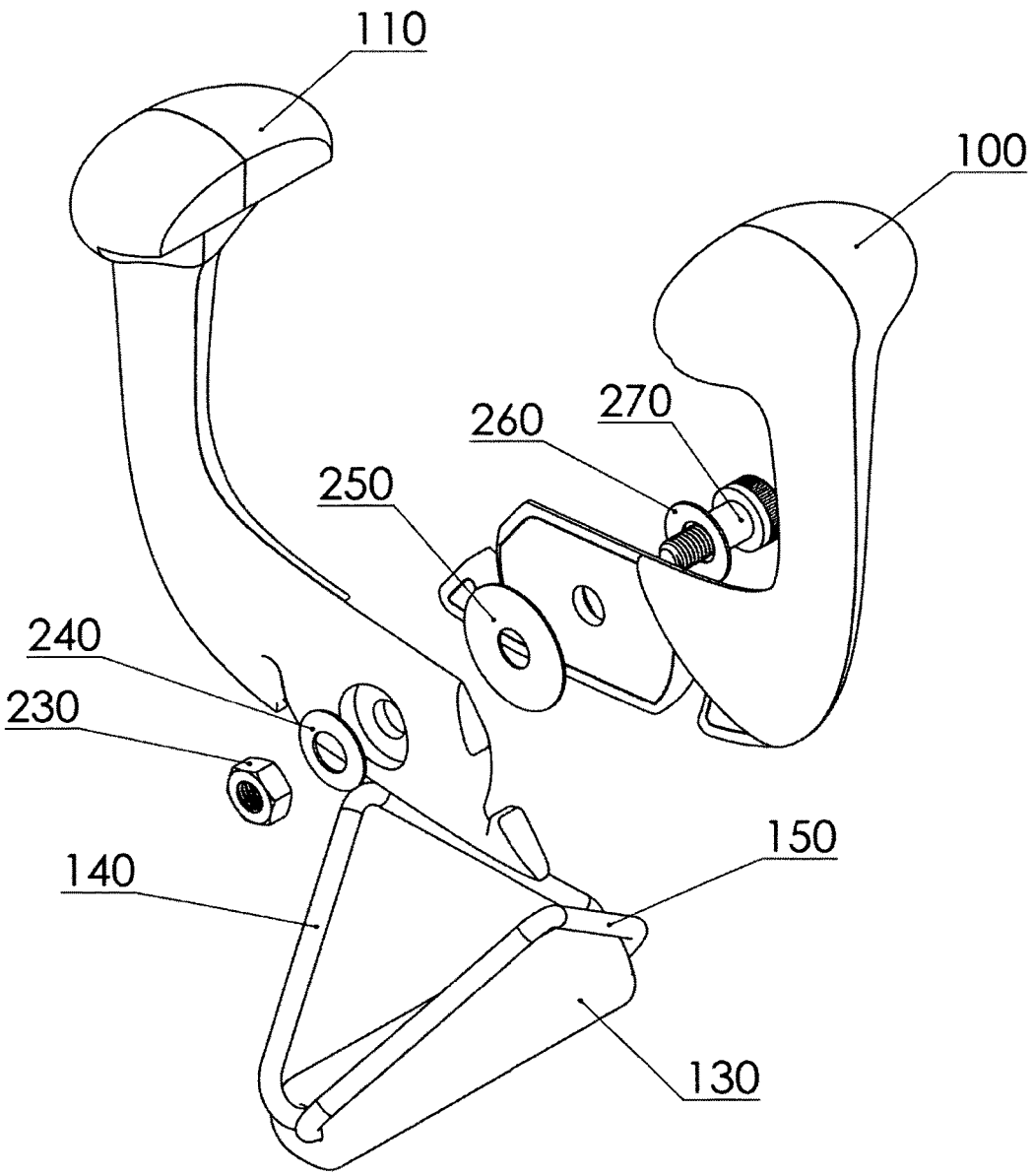
FIG. 3 is an exploded isometric view illustrating the major components of an embodiment of the portable opposably mounted pull up device and details of the pivotal connection.

The details of assembly of the pivotal connection 120 between the two grip arms is shown in FIG. 3. The connection comprises shoulder bolt 270, identical spring washers 260 and 240, spacer shim 250, and nut 230. Nut 230, when tightened onto the thread of shoulder bolt 270, compresses spring washers 260 and 240, creating a contact force between grip arm 100 and spacer shim 250 as well as between grip arm 110 and spacer shim 250. This contact force creates friction between these components, offering resistance when arms 110 and 120 are rotated with respect to each other. The spring washers 240 and 260 may not be fully compressed during assembly since nut 230 is restricted to moving only on the threaded portion of shoulder bolt 270, and is stopped when it reaches the end of the threaded portion. This allows nut 230 to be tightened against shoulder bolt 270 with sufficient torque to prevent its loosening during operation, while simultaneously limiting the friction force between arms 100 and 110 of the assembly to a magnitude which may be easily overcome by unassisted human effort.

Figure 4:
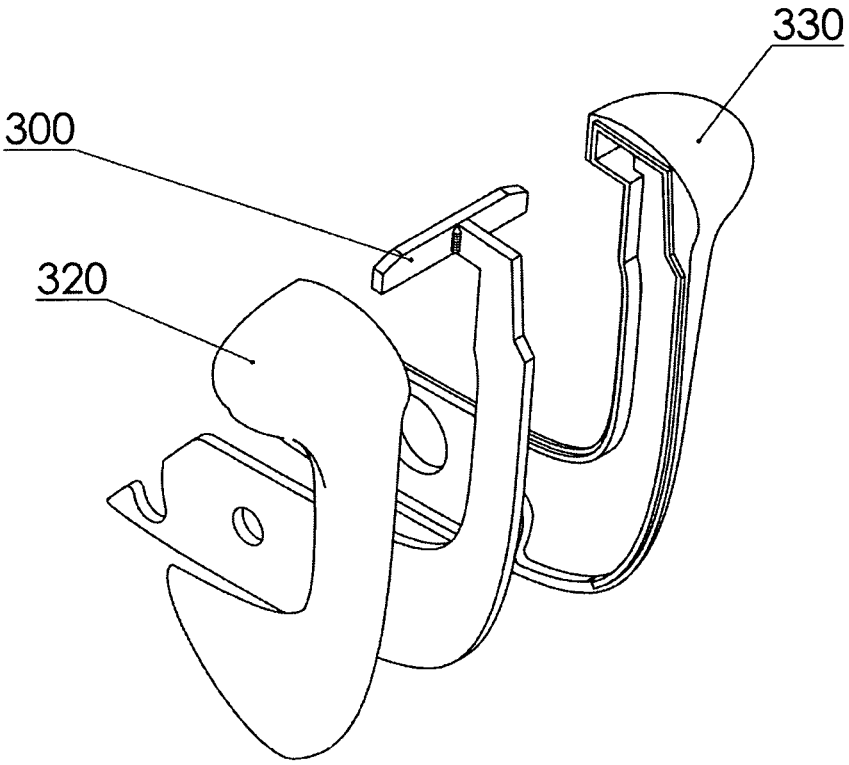
FIG. 4 is an isometric view illustrating the construction of a grip arm.

The grip arm structure, which is shared between right grip arm 100 and left grip arm 110, is shown in detail in FIG. 4. The construction of each arm, in addition to previously mentioned interface points for interacting with a support frame and handle, is driven by a load transfer requirement, and by aesthetic appearance considerations. In view of these requirements and considerations, each grip arm comprises an insert 300, left grip arm cover 320 and right grip arm cover 330. Grip arm insert 300 is welded together from two steel components, each of which can be created by stamping, waterjetting, or laser cutting a pattern from steel plate. Left grip arm cover 320 and right grip arm cover 330 are made of plastic such as acrylonitrile butadiene styrene (ABS) by means such as injection molding or 3D printing. The components of the assembly are joined together with adhesive such as a 2-part epoxy at all interfaces between the components.

There exists a multitude of other ways of manufacturing the grip arm structure which conform with the spirit and claims of the present invention. The entire grip arm may be made from one or more pieces of suitable material, such as a metal, a plastic, a ceramic, a composite material, a nanocomposite material, or other materials. It may incorporate elements which are not shown in FIG. 4, such as rigid or flexible contact pads, which may be used at the contact interface with the support structure, or at other locations.

Figure 5A:
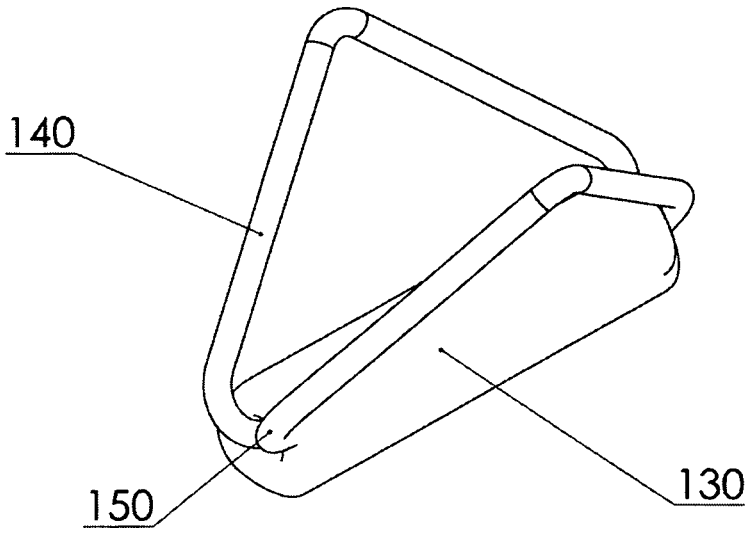
FIG. 5A is an isometric view showing, separately from the rest of the embodiment, the handle and rope loops.
Figure 5B:
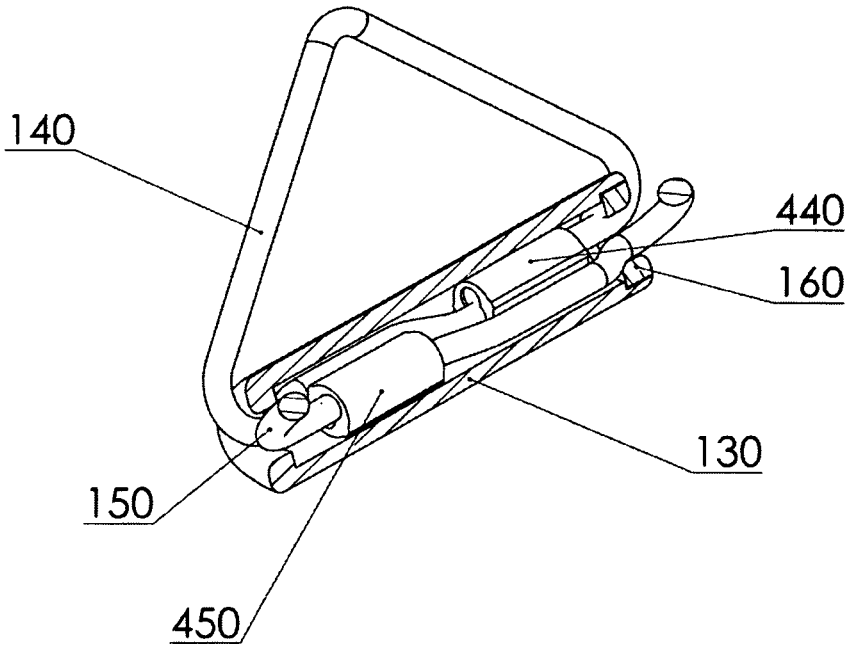
FIG. 5B is an exploded isometric view illustrating the construction of the handle.

FIG. 5A depicts the handle component 130 and rope loops 140 and 150, which together form a subassembly. FIG. 5B depicts an exploded view of the construction detail of the handle component 130 and rope loops 140 and 150. Handle component 130 has permanently affixed to itself a handle endcap 160, both made from acrylonitrile butadiene styrene (ABS). Each of these contains a hole to allow the passage of rope loops 140 and 150, each of which is made from nylon fibers. Packaged inside a cavity of handle component 130 are crimps 440 and 450 which serve to secure together the two free ends of rope loops 140 and 150, respectively. The crimps are made from a metal such as aluminum and are secured onto the ends of each rope loop by being squeezed within an appropriate die. To allow the crimps to be hidden inside the handle component 130, this process occurs while handle main body 130 and handle endcap 160 are separately threaded onto the rope comprising the corresponding rope loop. The handle may be subsequently assembled and secured together with 2-part epoxy without having to interrupt or break either of the rope loops.

Clearly, other materials and manufacturing methods are suitable for making the handle component and rope loops. The rope loops may be constructed from bundles of polymer strands, metal wire, fiberglass, naturally occurring fibers, or other fibers of any shape. They may also be rigid components possessing a pivotal or rotary connection at either end. The handle component may be made from one or more parts of materials such as metals, plastics, ceramics, composite materials, nanocomposite materials, or other materials.

Figure 6:
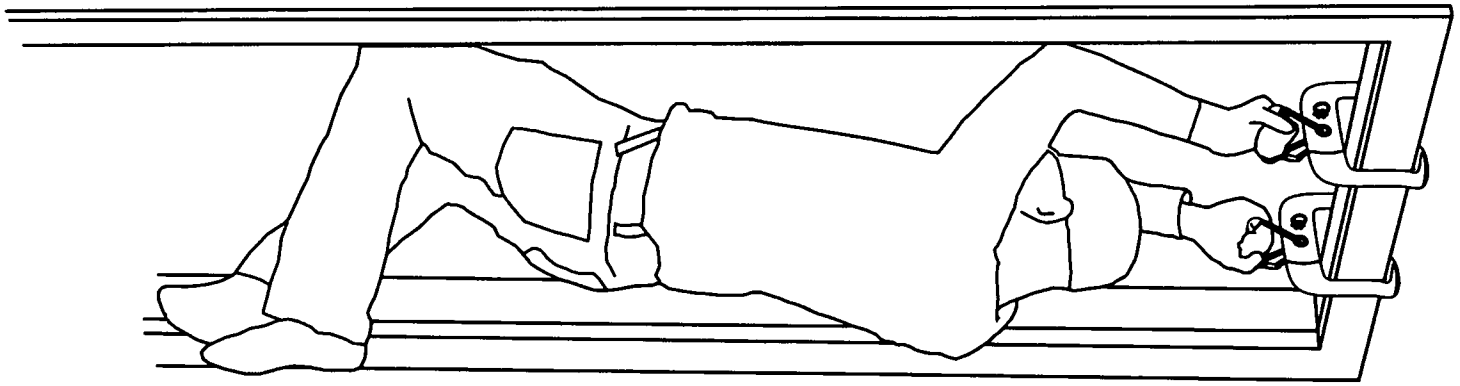
FIG. 6 is a perspective view demonstrating an individual exercising using a pair of embodiments of the portable opposably mounted pull up device installed on a door frame.

FIG. 6 depicts one possible usage of the present invention. It shows individual 500 exercising by suspending himself on embodiments of the present invention 510 and 520, each of which is attached to the top portion of door frame 530. Due to the pivotal connection 120 inherent in each of embodiments 510 and 520, the weight that the individual is applying to each of handle components 130 is causing the grip arms 100 and 110 of the depicted embodiments to grip securely onto door frame 530. Said pivotal connection also allows grip arms 100 and 110 to be opened and the embodiments to be removed from the top of door frame 530 quickly and easily at the end of the individual's exercise session. The installation procedure is equally straightforward: the grip arms of each embodiment may be opened by rotating around the pivot, lifted up to capture the trim of the door frame, and closed.

Figure 7:
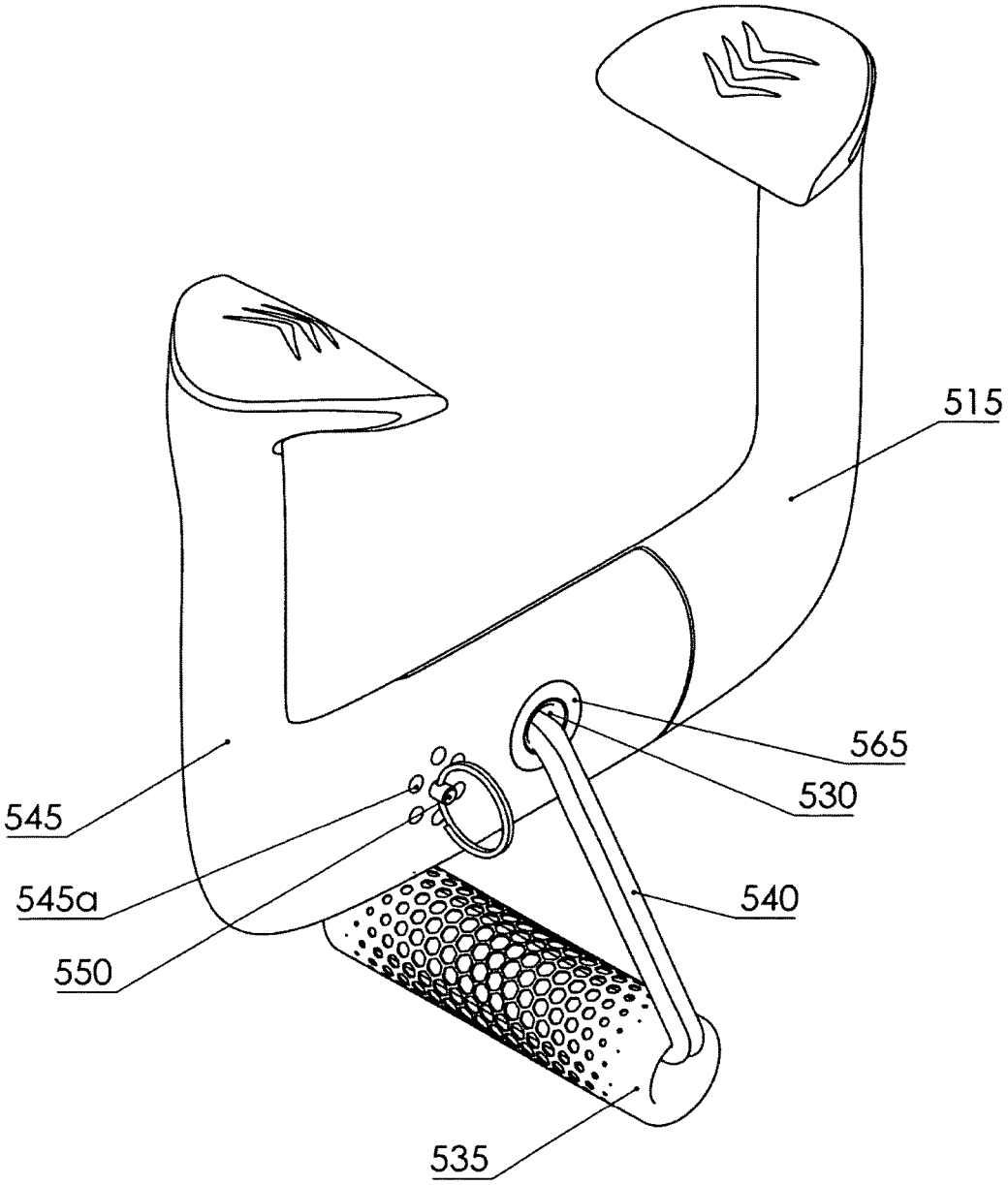
FIG. 7 is an isometric view from the top showing a different embodiment of the portable opposably mounted pull up device.
Figure 8:
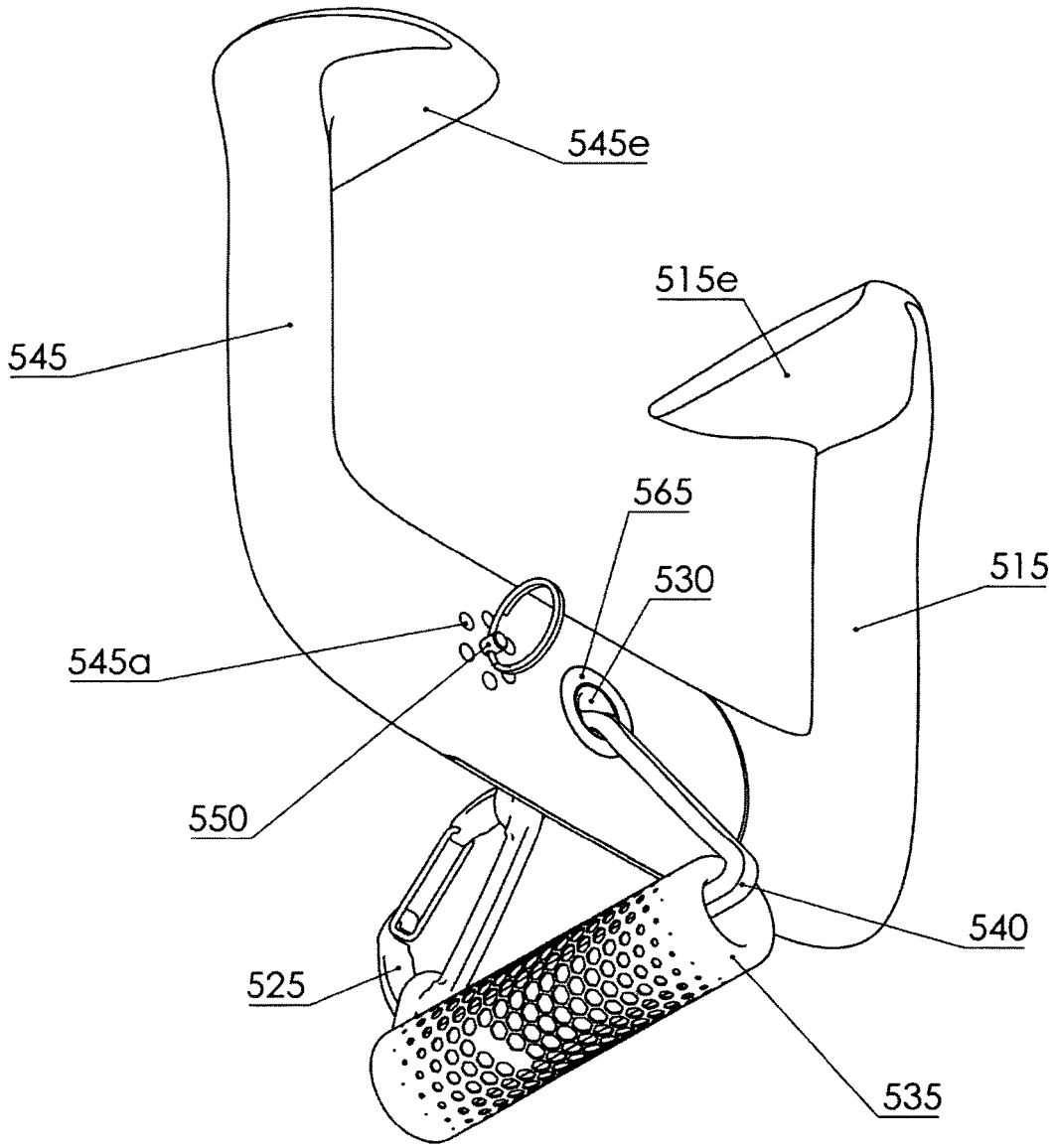
FIG. 8 is an isometric view from the bottom showing the same embodiment as FIG. 7.

FIGS. 7-10 depict in various ways a different embodiment of the present invention. FIGS. 7 and 8 show left grip arm 545 and right grip arm 515, made by injection molding of a fiber reinforced plastic, with their respective support surfaces 545*e* and 515*e*. At the location of these surfaces, the grip arms are coated with a soft elastomeric material to prevent damage to the door frame that the device is attached to. Shaft 530 acts as a pivot between grip arms 545 and 515 and has a hole to allow the passage of rope 540 which supports handle 535. Although it may not be as readily apparent as with the embodiment depicted in FIGS. 1-3, but connecting the handle directly to the pivot in such a manner also creates a self-energizing tendency, wherein the weight of the user acting downward on the handle causes the grip arms to close in around the door frame that the device is mounted on. Carabiner 525 connects together the two ends of rope 540, such that handle 535 may be removed by the user if he or she desires. Pin 550 may be inserted into one of the holes 545*a* to lock the two grip arms together and prevent them from rotating with respect to each other. Decorative cover 565 hides internal mechanical details.

Figure 9:
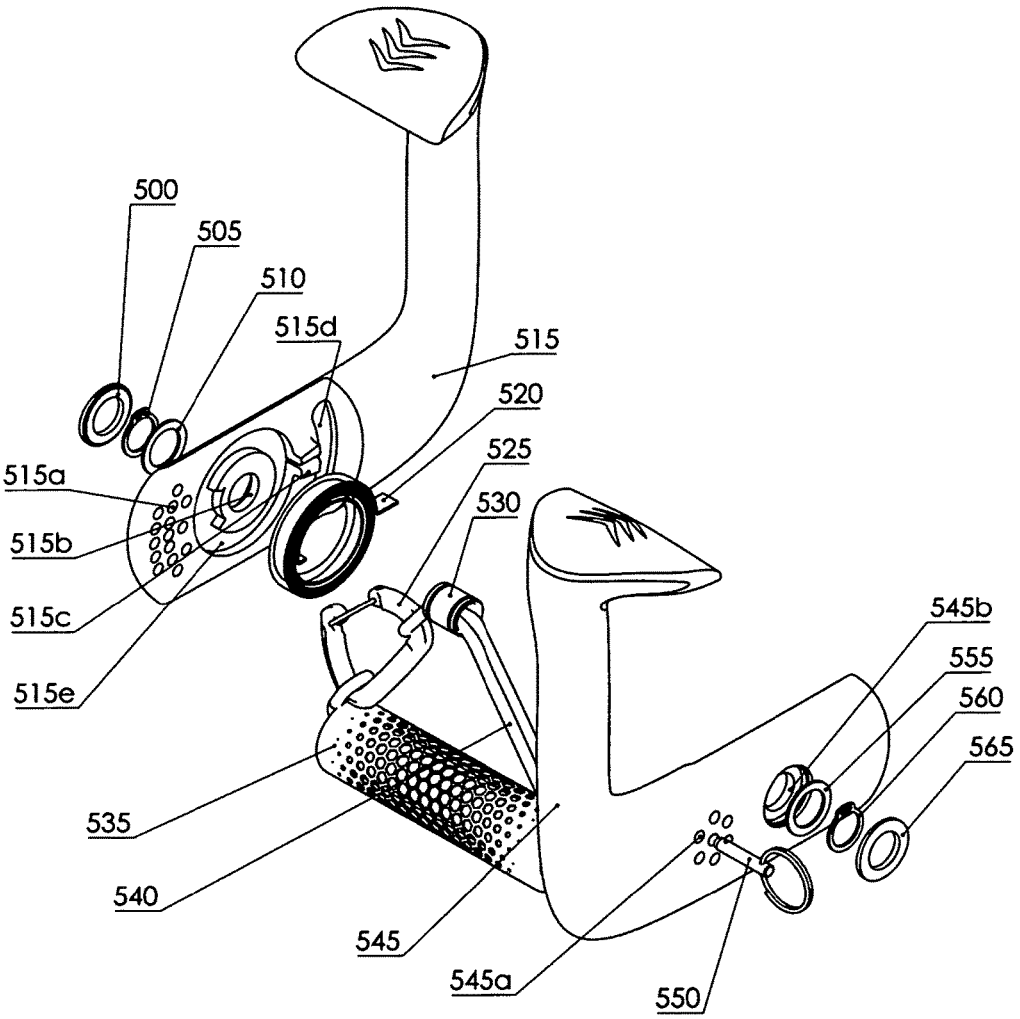
FIG. 9 is an exploded isometric view of the same embodiment as FIGS. 7 and 8.
Figure 10:
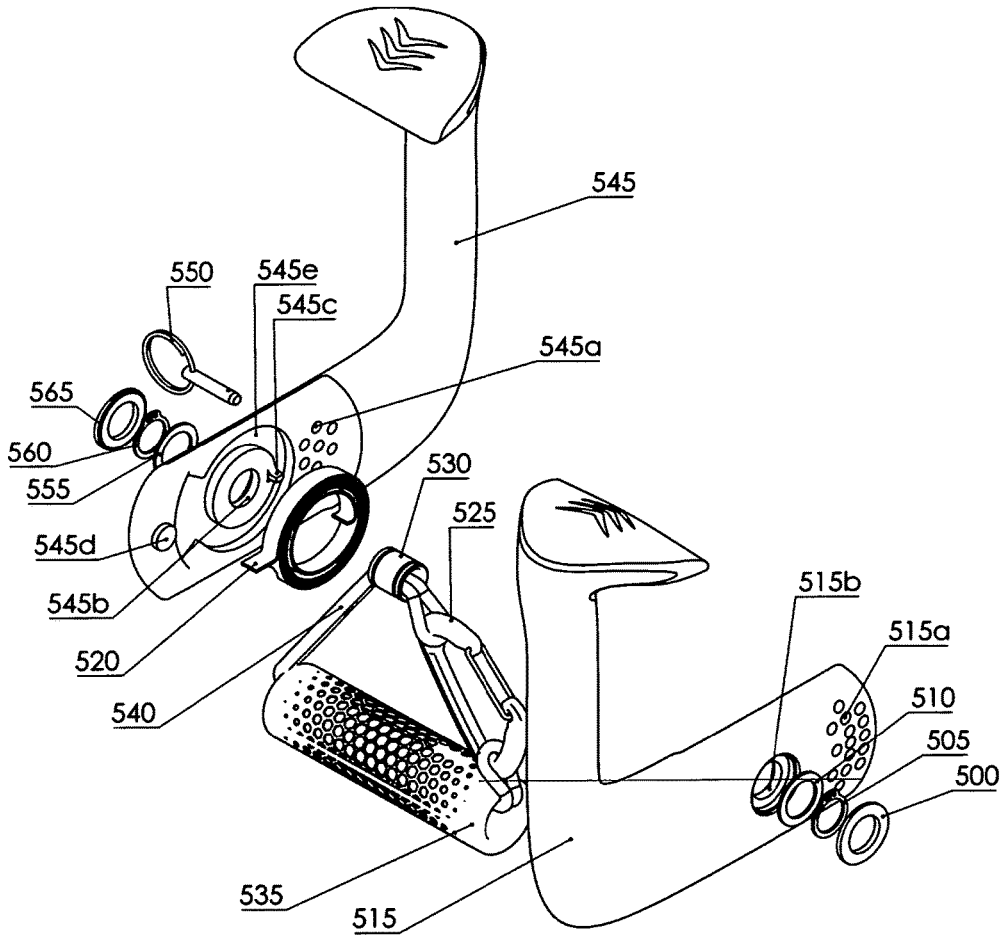
FIG. 10 is an exploded isometric view of the same embodiment as FIGS. 7, 8, and 9, shown from the back relative to those figures.

FIGS. 9 and 10 show the internal details of construction of the same embodiment as FIGS. 7 and 8. The grip arms 515 and 545 are secured to shaft 530 by snap rings 505 and 560 in combination with washers 510 and 555. Decorative covers 500 and 565 hide the snap rings 505 and 560 from the user. Shear load acting between the grip arms is transferred to shaft 530 by the surfaces 515*b* and 545*b*. Spring 520 exerts a torque on grip arms 515 and 545 through slots 515*c* and 545*c*, tending to push surfaces 515*e* and 545*e* towards each other. Cavities 515*e* and 545*e* contain spring 520 and obscure it from the user. When the embodiment is mounted on a door frame, this torque acts to keep the device closed and secured around the trim of the door frame even if there is no downward load acting on the handle 535. When the device is assembled, protrusion 545*d* interfaces with recessed slot 515*d* to limit the angular movement of the grip arms with respect to each other to a predetermined range. Hole array 515*a* matches up with hole array 545*a* at predetermined, discrete angular positions. Pin 550 may be inserted through a matching pair of holes between these two arrays to rigidly lock the two grip arms together. This allows for a completely secure grip on door frames of different thicknesses.

With the detailed description above, it has been described how to build a portable exercise device which confers an array of advantages over some of the existing prior art.

a) The device may be installed onto any doorway frame of suitable dimensions quickly and easily, without any tools or hardware, and without altering or damaging the doorway frame via articulation of the pivotal connection 120, and utilizing support surfaces 101, 102, 111, and 112 to make contact with the doorway frame.

b) The device may be stored or carried, with no or minimal prior disassembly, in a small travel bag, backpack, or in the carry-on luggage on an airplane. The design described and shown may be made very compact in fully deployed configuration as shown in FIG. 6. During transport, it may be made smaller still by either collapsing rope loops 140 and 150 and tucking away handle component 130, or by removing these rope loops from the grip arms 100 and 110, and tucking away the handle component and rope loops altogether.

c) The device forms a secure, self-energizing, opposable mounting system, via the arrangement of grip arms 100 and 110 and pivotal connection 120, in combination with rope loops 140 and 150 connected to handle 130, which uses the individual's body weight to aid the stable attachment to both sides of any suitable doorway frame by causing the support surfaces of both grip arms to increase the gripping force due to downward load applied through the handle.

d) The device may have a relatively short handle component intended for gripping with one hand. The individual using the device may use a pair of them, one for each hand, as shown in FIG. 6. This allows the space between the handles to be free of obstacles, something which would not be the case with an elongated horizontal bar intended to be gripped with both hands. This allows for greater comfort when performing pull-ups since the individual does not have to crane his or her head back or forward when in the middle of the pull-up. At the same time, the spacing between the handles is easily and quickly adjustable since each is suspended individually.

e) The handle component 130 is suspended on flexible rope loops 140 and 150, allowing the individual's wrists to swivel and pivot into a comfortable orientation into the course of a pull-up.

f) The individual may use a pair of embodiments of the present invention to exercise on a door frame which is unusually wide or narrow, unlike with conventional removable pull up bars, such as embodiments of the design described in U.S. Pat. No. D,348,706.

It is understood that the invention may be embodied in ways different from the one described heretofore, and that other embodiments may be developed without departing from the scope of the appended claims. It is furthermore understood that terms possessing a certain degree of specificity, such as 'doorway frame', are used for exemplification purposes, and that they encompass concepts of a broader nature where appropriate, such as 'supporting structure' in this instance.

CITATION LIST

Provisional Patent Application

U.S. Provisional Patent Application 61/981,822 filed on 2014 Apr. 20, "Portable Opposably Mounted Pull Up Device"

Patent Literature

U.S. Pat. No. 8,622,875 "Doorframe suspension type parallel-bar exercising apparatus"

U.S. Pat. No. 7,993,245 "Exercise device for pull-ups and hanging"

U.S. Pat. No. D,633,961 "Portable pull-up exercise device"

U.S. Pat. No. D,633,156 "Combined chin up and exercise bar"

U.S. Pat. No. 7,762,409 "Apparatuses for holding hangers"

U.S. Pat. No. 7,601,100 "Door mounted chin-up assembly"

U.S. Pat. No. 7,066,866 "Chin up bar assembly with sliding and swiveling handles"

U.S. Pat. No. D,518,534 "Pull-up exercise bar"

U.S. Pat. No. 6,503,175 "Exercise device"

U.S. Pat. No. 6,179,748 "Chin-up bar"

U.S. Pat. No. 5,776,033 "Chin-up bar"

U.S. Pat. No. 5,752,903 "Exercise bar assembly"

U.S. Pat. No. 5,729,844 "Portable baby sleeping swing"

U.S. Pat. No. D,376,264 "Toddler exerciser"

U.S. Pat. No. 5, 417,628 "Exercise device for chin-ups"

U.S. Pat. No. D,348,706 "Door frame mounted exercise bar"

U.S. Pat. No. 6,514,182 "Doorframe mountable exercise system"

U.S. Pat. No. D,686,286 "Universal exercise bar and pull-up apparatus"

We claim:

1. An exercise device comprising:

a first arm component and a second arm component;

a first support surface and a second support surface for resting on a door trim;

a hollow shaft extending through the first and second arm components;

a handle;

a flexible member passing through the hollow shaft and the handle to secure the handle to each of the arm components;

wherein the first support surface and the second support surface are integrated, respectively, into the first arm component and the second arm component; and wherein the hollow shaft rotationally connects the first arm component to the second arm component.

2. The exercise device of claim 1, wherein the fifth means is comprises rope, strap, or wire.

3. The exercise device of claim 1, further comprising a spring acting between the two arm components.

4. The exercise device of claim 1, further comprising a snap ring around the hollow shaft.

5. The exercise device of claim 1, further comprising a decorative cover around the hollow shaft.

* * * * *